US010568413B2

(12) United States Patent
Lankford et al.

(10) Patent No.: US 10,568,413 B2
(45) Date of Patent: Feb. 25, 2020

(54) HAIR BRUSH

(71) Applicant: L & R Pro, LLC, Fort Worth, TX (US)

(72) Inventors: Heather Lankford, Fort Worth, TX (US); Jacquelyn Reyna, Fort Worth, TX (US); Lamar Lopez, Aledo, TX (US)

( * ) Notice: Subject to any disclaimer, the term of this patent is extended or adjusted under 35 U.S.C. 154(b) by 109 days.

(21) Appl. No.: 16/009,419

(22) Filed: Jun. 15, 2018

(65) Prior Publication Data

US 2019/0380481 A1 Dec. 19, 2019

(51) Int. Cl.

| | |
|---|---|
| ***A46B 5/02*** | (2006.01) |
| ***A46B 7/04*** | (2006.01) |
| ***A46B 5/00*** | (2006.01) |

(52) U.S. Cl.

CPC ..... *A46B 5/0095* (2013.01); *A46B 5/02* (2013.01); *A46B 5/021* (2013.01); *A46B 7/04* (2013.01); *A46B 2200/104* (2013.01)

(58) Field of Classification Search

CPC ..... A46B 5/0095; A46B 5/02; A46B 5/021; A46B 5/026; A46B 7/04; A46B 7/044; A45D 2/00; A45D 6/00; A45D 6/02; A45D 24/00

See application file for complete search history.

(56) References Cited

U.S. PATENT DOCUMENTS

| | | | | |
|---|---|---|---|---|
| D645 | S | 5/1856 | Rock | |
| 106,680 | A | 8/1870 | Firey | |
| 5,479,951 | A | 1/1996 | Denebeim | |
| 5,992,423 | A | 11/1999 | Tevolini | |
| 6,230,716 | B1 | 5/2001 | Minoletti | |
| 7,424,764 | B2 * | 9/2008 | Trenz | A46B 7/04 15/145 |
| 7,654,269 | B1 | 2/2010 | Boyle | |
| 8,132,569 | B2 | 3/2012 | Akerman | |
| 8,919,353 | B2 | 12/2014 | Richardson | |
| 2013/0312783 | A1 * | 11/2013 | Fiorio | A46B 9/023 132/237 |
| 2016/0128457 | A1 * | 5/2016 | Lim | A46B 5/0033 401/118 |
| 2017/0239805 | A1 * | 8/2017 | Settembre | B25G 1/04 |

* cited by examiner

*Primary Examiner* — Randall E Chin

(74) *Attorney, Agent, or Firm* — Brian K. Yost

(57) ABSTRACT

The hair brush generally comprises a handle and a removably coupled brush head retainer. The brush head retainer is adapted to receive a variety of different hair brush heads comprising a variety of types of bristles. The handle comprises a centrally tapered configuration that is easily grasped by a user. Upper and lower portions define a central longitudinal passage. Axially aligned within this passage is a handle coupling assembly comprising an activation member, push rod, spring, barrel, and one or more ball bearings. The brush head retainer comprises a brush head retainer lower opening, an inner annular groove, and one or more lower pins. The inner annular groove comprises an angled lower portion which is transversely aligned with the barrel side openings. The push rod is moveable between first and second positions such that the brush head retainer may be coupled and decoupled.

13 Claims, 4 Drawing Sheets

HAIR BRUSH

BACKGROUND OF THE INVENTION

1. Field of the Invention

The present invention relates generally to hair brushes adapted for use by salon stylists and specifically to a hair brush comprising a removable handle adapted to accept multiple types of hair brush heads and styling accessories.

2. Description of the Prior Art

Hair brushes have been known in the art since well before the beginning of the $19^{th}$ century. Originally, hair brushes were a luxury item owned primarily by well-to-do individuals. In the United States, one of the first issued patents for a hair brush was U.S. Pat. No. D645 issued to Rock. Rock provided for a hair brush comprising an elliptical shape and a metallic frame handle. One of the first utility patents for a hair brush is U.S. Pat. No. 106,680 to Firey. Firey provides for a hair brush comprising wire teeth and bristles on one side of the brush and ordinary bristles on the other.

Over the years, manufacturing techniques improved and hair brushes became available to almost everyone. Hair brushes today are available in a wide variety of shapes and sizes and are constructed from a variety of materials. Shapes include paddle style brushes comprising a wide head which is well suited for long straight hair; round brushes for adding volume and producing waves and curls; detangling brushes which may have a base and bristle configuration adapted to permit the brush to easily remove knots and tangles; vented brushes having heads with openings to permit air movement through the brush; and cushion brushes in which the bristles are mounted to a flexible surface which provides comfort to the user.

Bristle construction may be of natural or synthetic materials. Some brushes have boar-hair bristles thought to be useful for creating polished hair strands and for use in carrying away oils and debris. Other brushes comprise flexible nylon bristles or stiffer bristles made from materials such as wood. Some brushes comprise a mixture of bristles in which some are formed from, for example, nylon, and others from boar-hair.

Brush handles vary in design and shape as well. Some hair brush handles are round having the same diameter at a lower end as an upper end. Others comprise rounded configurations in which the lower end diameter differs from the upper end diameter. Other brush handles comprise relatively flat configurations.

Because of the wide number of brush head, handle, and bristle configurations, there are an almost unlimited number of brush head/handle/bristle combinations. Thus, hair stylists often have ten or more different types of brushes, each having different qualities desirable for use in different styling environments. Stylists, typically settle upon a type of brush and a type of handle that is comfortable to use many hours per day over extended periods of time. However, a particular handle and brush head combination may not always be available. Even if such combinations were available, most hair brushes have a limited useful life, and hair stylists find it necessary to frequently replace their supply of hair brushes. Because a conventional hair brush almost always comprises an integrated handle, the entire brush must be replaced when the head wears out.

Removable hair brush handles are known in the art. For example, U.S. Pat. No. 5,479,951, Denebeim, provides a hair brush with a removable head in which a pin received within a pair of L-shaped slots in the brush head which lock the brush head and the handle together.

U.S. Pat. No. 5,992,423, Tevolini, provides for a hair brush with a detachable handle in which the brush head may be used to act as curlers. The handle in Tevolini is detached by activating a retraction button protruding through the side of the handle.

U.S. Pat. No. 6,230,716, Minoletti, provides a hair brush with a detachable handle, the handle comprising a spring loaded ball adapted to extend within an opening in the brush head to secure the handle in place.

Boyle, U.S. Pat. No. 7,654,269 provides a dual-handle hair brush having detachable handles which can be pressed, snapped, twisted, or threaded into place.

U.S. Pat. No. 8,132,569, Akerman, discloses a hair brush handle with a detachable head. The handle comprises an end piece comprising an annular groove comprising a pin adapted to engage a hair brush head slit.

U.S. Pat. No. 8,919,353, Richardson, discloses hair brushes with removable handles, the handles comprising a side button and spring arrangement comprising an aperture that clamps down on a rod extending from the hair brush head.

What is needed is a hair brush comprising a handle that remains firmly in place while in use but which can easily be removed so as to accommodate a variety of different hair brush heads.

SUMMARY OF THE INVENTION

The present invention provides a hair brush comprising a handle that remains firmly in place while in use but which can easily be removed so as to accommodate a variety of different hair brush heads.

The hair brush generally comprises a handle portion (handle) and a brush head retainer. The brush head retainer is adapted to receive a variety of different hair brush heads which may comprise a variety of types of bristles. The handle of the preferred embodiment comprises upper and lower portions. The handle comprises a centrally tapered tubular configuration. This centrally tapered configuration permits the handle to be easily grasped by a user and helps prevent the handle from slipping from the user's hand while in use.

When assembled, the upper and lower portions define a central longitudinal passage. Axially aligned within this passage is a handle coupling assembly comprising an activation member, push rod, spring, barrel, and one or more ball bearings.

The activation member is generally cylindrical and comprises a main body and a head portions. When the handle is assembled, a lower portion of activation member main body extends from a lower handle lower passage opening. In such assembled position, a shoulder prevents the activation member, push rod, and spring from exiting through the lower handle lower passage opening.

In the preferred embodiment, a lower end of the push rod is press fit into the body of the activation member. The spring of the preferred embodiment is coaxially and slidingly positioned around a perimeter of the push rod.

A lower end of the upper handle is coupled to an upper end of the lower handle. In the preferred embodiment, the lower end of the upper handle portion comprises an insertion member adapted to be inserted within the lower handle upper passage opening. When the upper handle is coupled to the lower handle with the coupling assembly in place, the spring is compressed between the extension member and the activation member head biasing a push rod head to a first position.

Positioned within upper handle upper passage opening is the barrel. Barrel comprises a generally tubular configuration adapted to receive push rod. When the handle is an the assembled configuration with the push rod head in the first position, the push rod head biases each of two ball bearings through respective barrel side openings partially into a brush head retainer inner groove.

Push rod generally comprises a cylindrical configuration with a tapered neck portion adjacent to a push rod head. The barrel comprises an internal channel axially aligned with, and approximately the same circumference as, passage. When the handle is assembled, push rod is slidingly positioned within barrel channel and passage. Push rod head has a circumference slightly smaller than barrel channel circumference such that when push rod head, side openings and ball bearings are transversely aligned, the ball bearings are moved substantially out of barrel channel and partially into inner groove. In such position, the brush head retainer is locked into position. When the push rod is in a second position such that the neck portion is substantially transversely aligned with side openings, ball bearings are permitted to move into barrel channel and out of brush head retainer inner groove. In such position, the brush head retainer may be easily removed from handle. In the preferred embodiment, the push rod is moved from the first position to the second position by pressing the activation member and moving it towards the upper handle.

A distal end of the upper handle comprises pin receiver openings adapted to receive pins of the brush head retainer. In the preferred embodiment, there are two pin receiver openings each of which is structured and arranged to receive a respective pin. Each pin extends downward from a lower end of the brush head retainer. In the preferred embodiment, each pin comprises a downwardly tapered configuration such that the pin is narrower at a lower portion of the pin than at an upper portion of the pin. Similarly, each pin receiver opening comprises a downwardly tapered configuration such that the pin receiver opening is narrower at a lower portion of the pin receiver opening than at an upper portion of the pin receiver opening. With this configuration, the pins can easily be inserted into the respective pin receiver openings.

The brush head retainer comprises a brush head retainer through opening axially aligned with the passage. When viewed from the side, the groove of brush head retainer comprises angled sides. These angled sides angle upward and outward such that when the brush head retainer is coupled to the upper handle, the lowermost portion of angled side is generally aligned with a lower most portion of side openings. This alignment permits the ball bearing to partially exit side opening. Upon such partial exit of the ball bearings bearing from side opening the ball bearings are moved upward. In such position, the ball bearings are compressed between angled side and an upper most portion of side opening. This compressed position results in the brush head retainer being tightly coupled to the handle. The pin and pin receiver opening arrangement helps prevent undesirable rotational movement of the brush head retainer relative to the handle.

The handle of the preferred embodiment is adapted to be coupled to different brush head retainers comprising different brush head configuration. Thus, the user may have a single handle and multiple brush head retainers, each brush head retainer being adapted to be easily coupled and decoupled from the handle in the manner presented in this disclosure.

The brush head retainer of the preferred embodiment is adapted to receive a variety of different hair brush heads. The brush head may be held held in place by a conventional and commercially available adhesive or secured to the brush head retainer in other ways known in the art such as a cooperatively threaded coupling, frictionally coupling, dowels/pin coupling arrangements, etc.

The hair brush may be formed from a variety of different suitable materials such as stainless steel, other metals, organic or man-made materials, wood, plastics, composite materials and/or fibers, and other suitable materials known in the art.

Brush head shapes that may be secured to brush head retainer include paddle style brush heads comprising a wide head, narrow head, round head, detangling head, vented head, cushion heads, and the like.

Bristle construction may be of natural or synthetic materials such as boar-hair, flexible nylon, or stiffer bristles made from other materials. The brush heads may comprise a mixture of bristles formed from a combination of materials.

DESCRIPTION OF THE PREFERRED EMBODIMENT

Referring to FIGS. 1-8, there is shown the hair brush 12 in accordance with preferred embodiments. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A. B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation. The detailed description illustrates by way of example, not by way of limitation, the principles of the invention. This description will dearly enable one skilled in the art to make and use the invention, and describes several embodiments, adaptations, variations, alternatives, and uses of the invention, including what is presently believed to be the best mode of carrying out the invention.

Figure 6:
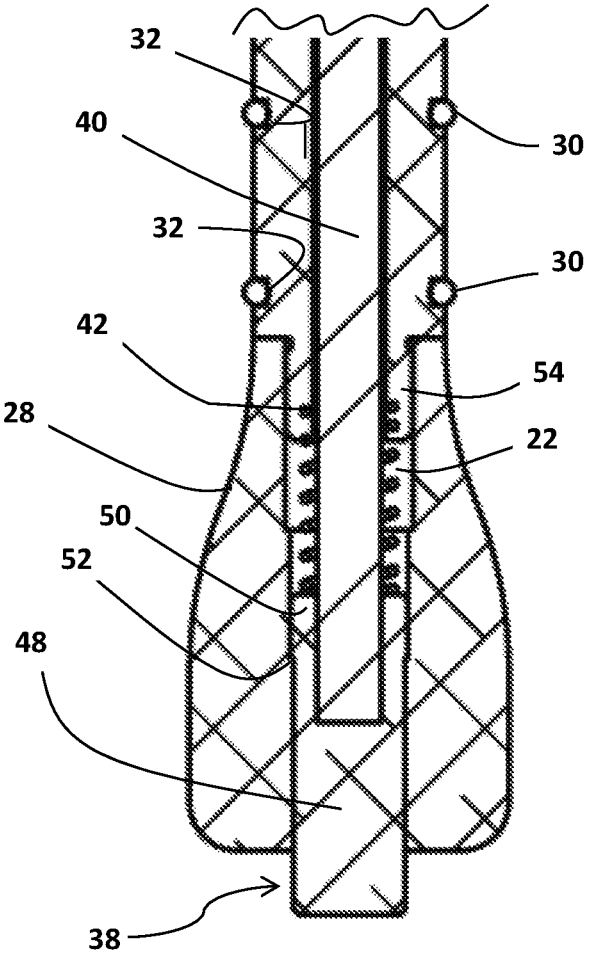
FIG. 6 is an enlarged view of the lower portion of FIG. 3.
Figure 7:
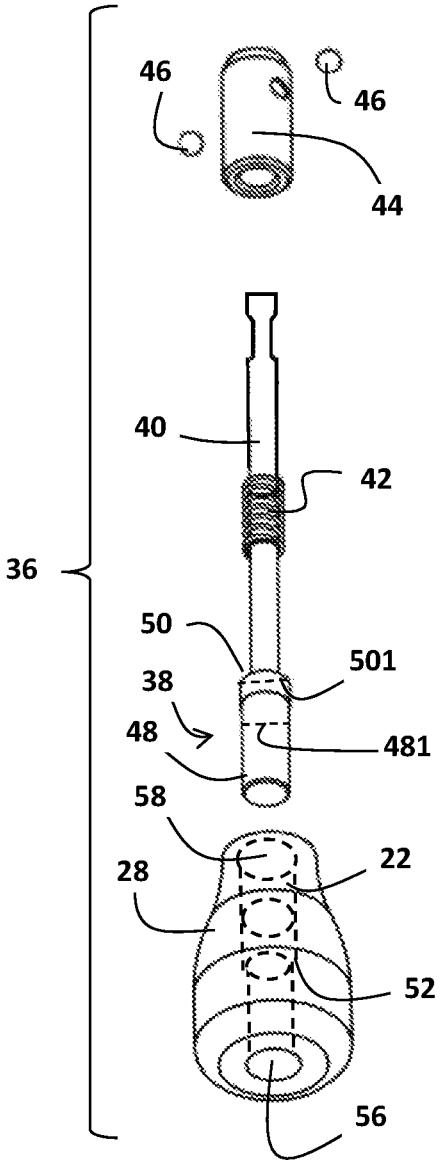
FIG. 7 is an exploded view of some of the lower portion components of FIGS. 3 and 6.
Figure 8:
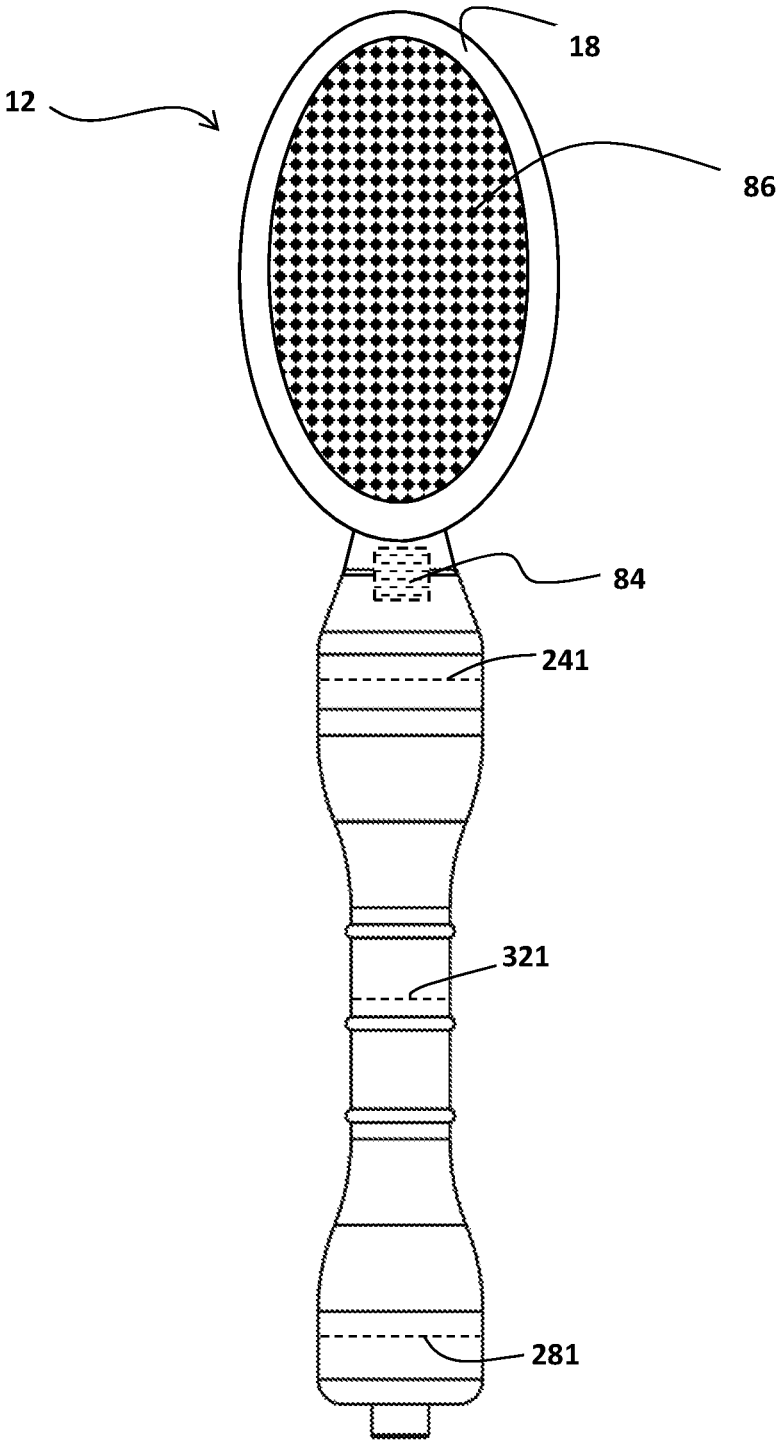
FIG. 8 is a front elevation view of the hairbrush of FIG. 1, with the brush head in place, in accordance with a preferred embodiment.

Referring to FIGS. 1-8, the hair brush 12 generally comprises a handle portion 14 (handle 14) and a brush head retainer portion 16 (brush head retainer 16). As will be discussed in more detail below, the brush head retainer 16 is adapted to receive a variety of different hair brush heads 18 (FIG. 8) which may comprise a variety of types of bristles 86. The handle 14 of the preferred embodiment generally comprises upper 24 and lower 28 portions. Referring to FIG. 8, the handle 14 comprises a tapering tubular configuration such that the upper and lower handle portions 24, 28 comprise transverse diameters 241, 281 greater in length than an intermediate handle transverse diameter 321. In the preferred embodiment, the upper and lower handle transverse diameters 241, 281 are equal in length. Thus, the handle 14 of the preferred embodiment is centrally tapered. This centrally tapered configuration is easily grasped by a user and helps prevent the handle 14 from slipping from the user's hand while in use. In some embodiments, the handle 14 comprises one or more O-rings 30, as depicted, for example, in FIGS. 1-4, 6 & 8.

When assembled, the upper and lower portions 24, 28 of the handle 14 define a central longitudinal passage 22. The lower handle portion 28 comprises a lower handle lower passage opening 56 and a lower handle upper passage opening 58. The upper handle 24 comprises an upper handle lower passage opening 60 and an upper handle upper passage opening 62. Axially aligned within this passage 22 is a handle coupling assembly 36. As best depicted in FIG. 7, the handle coupling assembly 36 comprises an activation member 38, push rod 40, spring 42, barrel 44, and one or more ball bearings 46.

Referring to FIGS. 6 & 7, the activation member 38 is generally cylindrical and comprises a main body 48 and a head 50 portions. The main body 48 comprises a main body transverse diameter 481 slightly shorter in length than a head transverse diameter 501. When the handle 14 is assembled, a lower portion of activation member main body 48 extends from the lower handle lower passage opening 56. In such assembled position, a shoulder 52 (a narrower portion of central longitudinal passage 22) prevents the activation member 38, push rod 40, and spring 42 from exiting through the lower handle lower passage opening 56.

In the preferred embodiment, a lower end of the push rod 40 is press fit into the body of the activation member 38. The spring 42 of the preferred embodiment is a coil spring 42 which is coaxially and slidingly positioned around a perimeter of the push rod 40.

A lower end of the upper handle 24 (FIG. 5) is structured and arranged to be coupled to an upper end of the lower handle 28. In the preferred embodiment, the lower end of the upper handle portion 24 comprises an insertion member 54 adapted to be inserted within the lower handle upper passage opening 58 (FIG. 7). When the upper handle 24 is coupled to the lower handle 28 with the coupling assembly 36 in place, the spring 42 is compressed between the insertion member 54 and the activation member head 50 biasing a push rod head 64 to a first position depicted in FIGS. 3, 4, 6 and 8.

Figure 4:
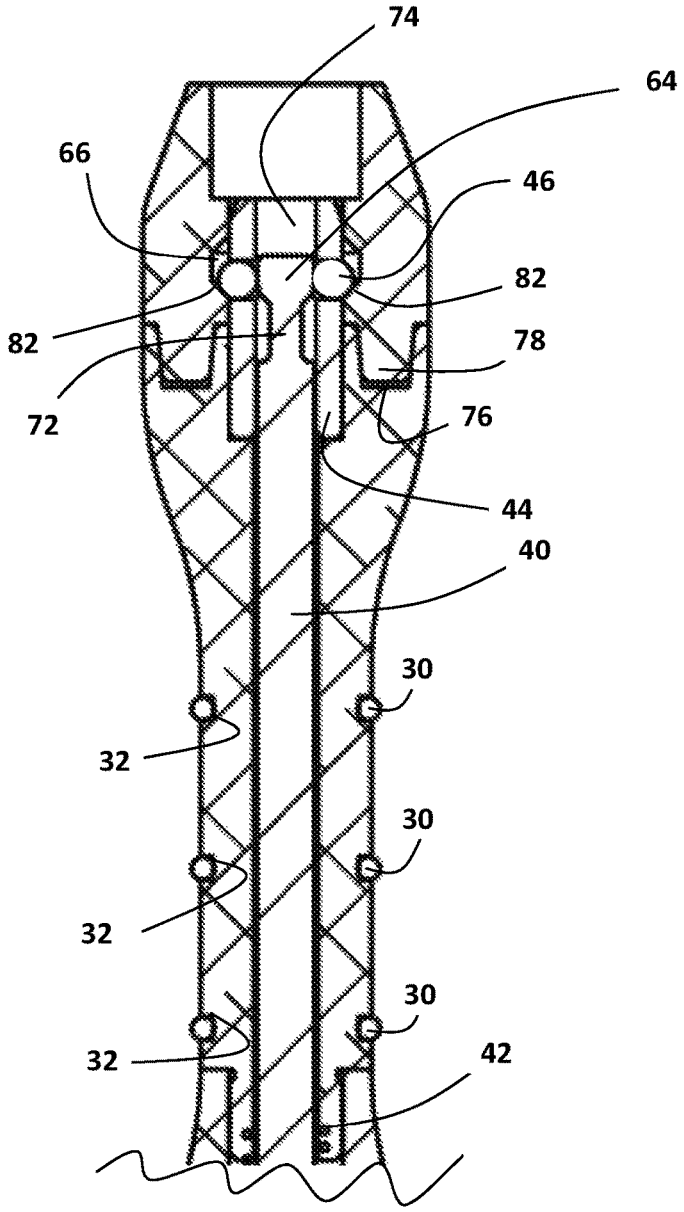
FIG. 4 is an enlarged view of the top portion of FIG. 3.
Figure 5:
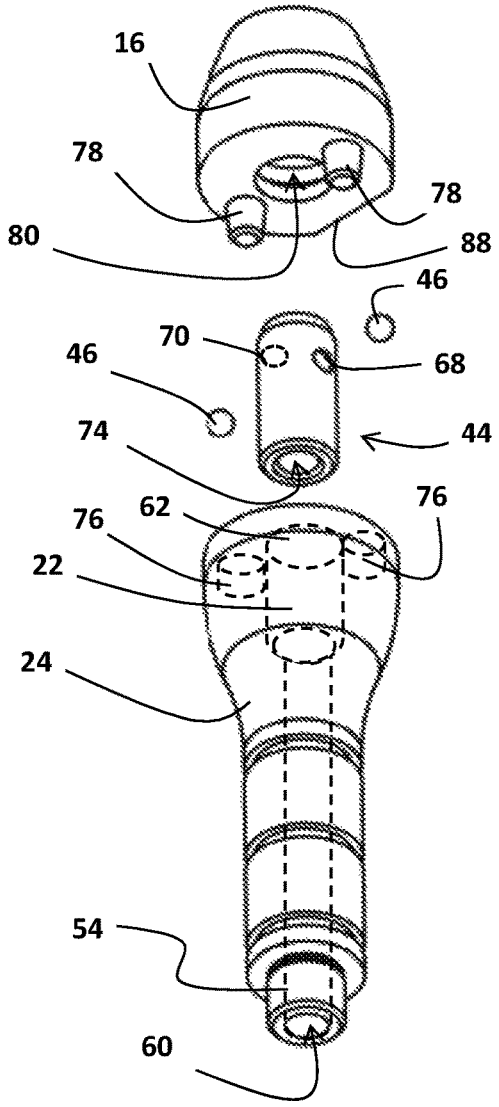
FIG. 5 is an exploded view of some of the top portion components of FIG. 4.

Referring to FIGS. 4 & 5, positioned within upper handle upper passage opening 62 is the barrel 44. Barrel 44 comprises a generally tubular configuration and is adapted to receive push rod 40. When the handle 14 is an the assembled configuration, with the push rod head 64 in the first position, the push rod head 64 biases each of two ball bearings 46 through respective barrel side openings 68, 70 partially into a brush head retainer inner annular groove 66.

In the preferred embodiment, the push rod head 64 is at a distal end of push rod 40. Push rod 40 generally comprises a cylindrical configuration with a tapered neck portion 72 adjacent to push rod head 64. Barrel 44 comprises an internal channel 74 axially aligned with, and approximately the same circumference as, an upper passage portion 34 of passage 22 (FIG. 5). When the handle 14 is assembled, push rod 40 is slidingly positioned within barrel internal channel 74 and passage 22. Push rod head 64 has a circumference slightly smaller than barrel channel 74 circumference such that when push rod head 64, side openings 68, 70, and ball bearings 46, 46, are transversely aligned, the ball bearings 46, 46 are moved substantially out of barrel channel 74 and partially into inner groove 66. In such position, the brush head retainer 16 is locked into position.

When the push rod 40 is in a second position such that the neck portion 72 is substantially transversely aligned with side openings 68, 70, ball bearings 46, 46 are permitted to move into barrel channel 74 and out of brush head retainer inner groove 66. In such position, the brush head retainer 16 may be easily removed from handle 14. In the preferred embodiment, the push rod 40 is moved from the first position to the second position by pressing the activation member 38 and moving it towards the upper handle 24.

Referring to FIG. 5, a distal end of the upper handle 24 comprises pin receiver openings 76 adapted to receive pins 78 of the brush head retainer 16. In the preferred embodiment, there are two pin receiver openings 76, each of which is structured and arranged to receive a respective pin 78. Each pin 78 extends downward from a lower end of the brush head retainer 16. In the preferred embodiment, each pin 78 comprises a downwardly tapered cylinder configuration such that the pin 78 is narrower at a lower portion of the pin 78 than at an upper portion of the pin 78. Similarly, each pin receiver opening 76 of the preferred embodiment comprises a downwardly tapered configuration such that the pin receiver opening 76 is narrower at a lower portion of the pin receiver opening 76 than at an upper portion of the pin receiver opening 76. With this configuration, the pins 78 can easily be inserted into the respective pin receiver openings 76. However, the pins 78 and pin receiver openings 76 do not need to be tapered or cylindrical. Rather, the pins 78 and pin receiver openings 76 may be orthogonal or comprise other configurations such as, for example a cubic, triangular, square, and/or rectangular arrangements.

As depicted in FIGS. 5 & 6, the brush head retainer 16 of the preferred embodiment comprises a brush head retainer lower opening 80 axially aligned with the passage 22. When viewed from the side, as depicted in FIG. 5, the groove 66 of brush head retainer 16 comprises angled sides 82. These angled sides 82 angle upward and outward such that when the brush head retainer 16 is coupled to the upper handle 24, the lowermost portion of angled side 82 is generally aligned with a lower most portion of side openings 68, 70. This alignment permits the ball bearing 46, 46 to partially exit side opening 68, 70. Upon such partial exit of the ball bearings 46, 46 from side opening 68, 70, the ball bearings 46, 46 are moved upward. In such position, the ball bearings 46, 46 are compressed between respective angled sides 82, 82 and an uppermost portion of side opening 68, 70. This compressed position results in the brush head retainer 16 being tightly coupled to the handle 14 such that there is minimal axial "play" between the two elements 16, 24. The pin 78 and pin receiver opening 76 arrangement helps prevent undesirable rotational movement of the brush head retainer 16 relative to the handle 14.

Figure 1:
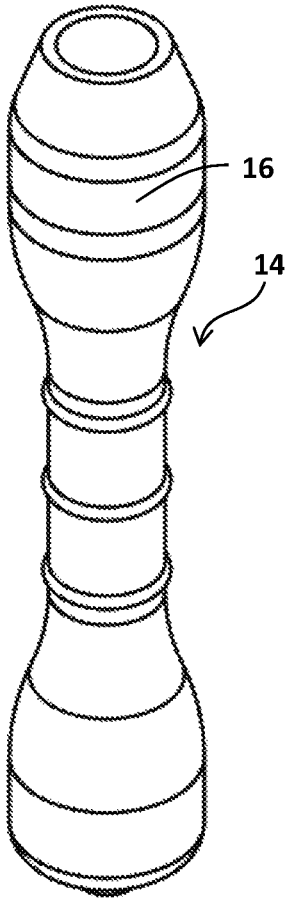
FIG. 1 is an isometric front and top view of the hairbrush, without the brush head in place, in accordance with a preferred embodiment.
Figure 2:
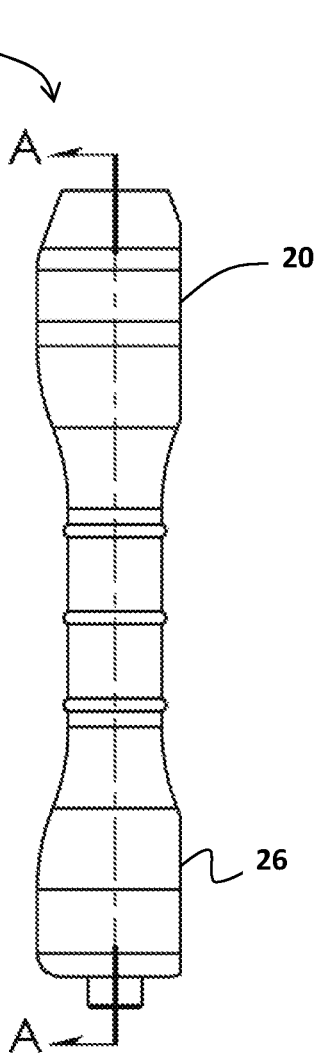
FIG. 2 is an elevation right side view of the hair brush of FIG. 1.
Figure 3:
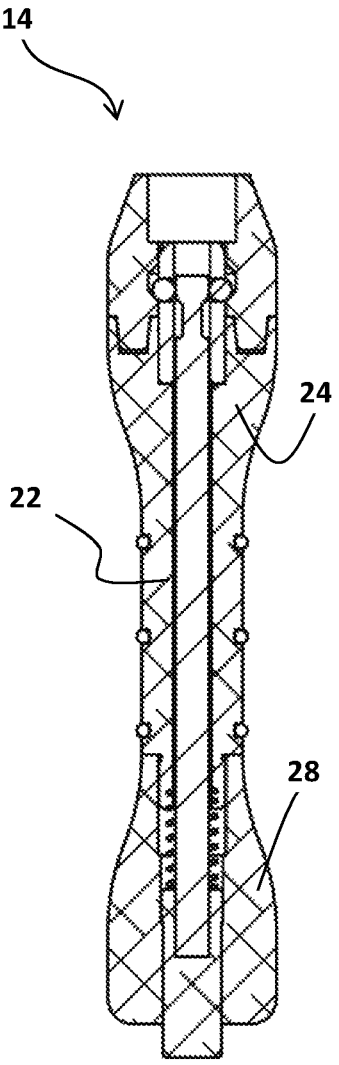
FIG. 3 is a section view of Section A-A of FIG. 2.

Referring to FIG. 2, the handle 14 of the preferred embodiment comprises upper and lower flat portions 20, 26. These flat portions 20, 26, prevent undesirable rotation of the handle 14 when the handle is set upon a surface such as a counter. Thus, for example, when the handle 14 is detached from the brush head retainer 16, the handle 14 will not readily roll across the counter. Similarly, as shown in FIG. 5, the brush head retainer 16 of the preferred embodiment comprises a flat surface portion 88. Thus, The handle 14 of the preferred embodiment is adapted to be coupled to different brush head retainers 16 each of which may comprise, for example, a different brush head 18 configuration. Thus, the user may have a single handle 14 and multiple brush head retainers 16, each brush head retainer 16 being adapted to be easily coupled and decoupled from the handle in the manner presented in this disclosure.

The brush head retainer 16 of the preferred embodiment is adapted to receive a variety of different hair brush heads 18. In the preferred embodiment, the brush head 18 comprises an insertion portion 84 which is fixed within retainer through opening 80 and held in place by a conventional and commercially available adhesive.

While there has been illustrated and described what is, at present, considered to be a preferred embodiment of the present invention, it will be understood by those skilled in the art that various changes and modifications may be made, and equivalents may be substituted for elements thereof without departing from the true scope of the invention. Therefore, it is intended that this invention not be limited to the particular embodiment disclosed as the best mode contemplated for carrying out the invention, but that the invention will include all embodiments falling within the scope of this disclosure and the Claims.

For example, although the brush head 18 of the preferred embodiment is held in place by a conventional and commercially available adhesive, the brush head 18 can be secured to the brush head retainer 16 in other ways known in the art. For example, the brush head 18 can be threadedly coupled to the brush head retainer 16, frictionally held place, or secured by dowels/pins, etc.

Although the handle 14 and brush head retainer 16 of the preferred embodiment are formed largely from stainless steel, the hair brush 12 may be formed from a variety of different suitable materials. For example, the handle 14 and brush head retainer 16 may be formed from other metals or organic or man-made materials. Therefore, the handle may be formed from wood, plastics, composite materials and/or fibers, and virtually any other suitable material known in the art.

By way of further example, brush head 18 shapes that may be secured to brush head retainer 16 include paddle style brush heads 18 comprising a wide head 18 for long straight hair; round brush heads 18 for adding volume and producing waves and curls; detangling brush heads 18 which may have a base and bristle 86 configuration adapted to permit the brush head 18 to easily remove knots and tangles; vented brush heads 18 having heads 18 with openings to permit air movement through the brush head 18; and cushion brush heads 18 in which the bristles 86 are mounted to a flexible surface which provides comfort to the user.

Bristle 86 construction may be of natural or synthetic materials. For example, brush heads 18 suitable for use with the hair brush 12 of the present invention may comprise boar-hair bristles 86, flexible nylon bristles 86, or stiffer bristles 86 made from materials such as wood. The brush heads 18 may comprise a mixture of bristles 86 formed from, for example, nylon and boar-hair.

We claim:

1. A hair brush comprising:

a handle comprising a lower handle portion and an upper handle portion, the upper handle portion being removably coupled to a brush head retainer;

the handle comprising a central longitudinal passage and a handle coupling assembly;

the handle coupling assembly comprising a push rod, a barrel comprising a barrel channel and one or more through side openings in fluid communication with the barrel channel, and one or more ball bearings;

the handle coupling assembly extending from the lower handle portion to the upper handle portion and being axially aligned within the central longitudinal passage;

the push rod comprising a neck portion and push rod head, the neck portion and push rod head being positioned within the barrel channel;

the barrel extending from the central longitudinal passage, exterior to the upper handle portion;

the push rod being moveable from a first position to a second position such that when the push rod is in the first position, the push rod head, at least one of the one or more ball bearings, and at least one of the one or more side openings are transversely aligned and such that, when the push rod is in the second position, the neck portion, at least one of the one or more ball bearings, and at least one of the one or more side openings are transversely aligned;

the upper handle portion comprising one or more pin receiver openings;

the brush head retainer comprising a brush head retainer lower opening, an inner annular groove, and one or more lower pins, the brush head retainer lower opening being axially aligned with the central longitudinal passage;

the one or more lower pins being adapted to nest within the respective one or more pin receiver openings;

the inner annular groove comprising an angled lower portion; and the angled lower portion being transversely aligned with the barrel side openings.

2. The hair brush of claim 1, the handle coupling assembly further comprising a spring, the spring biasing the push rod into the first position.

3. The hair brush of claim 2, the handle coupling assembly further comprising an activation member extending from the central longitudinal passage, exterior to the lower handle portion, the activation member being coupled to the push rod.

4. The hair brush of claim 3, the hair brush comprising a central tapering configuration such that an upper and lower transverse diameters are greater in length than an intermediate transverse diameter.

5. The hair brush of claim 4, the hair brush comprising one or more flat outer surface portions.

6. The hair brush of claim 4, the handle comprising one or more O-Rings positioned within respective outer surface grooves of the handle.

7. The hair brush of claim 3, the brush head retainer being adapted to receive a brush head.

8. The hair brush of claim 7, the brush head retainer comprising an upper opening adapted to receive an insertion portion of a brush head.

9. The hair brush of claim 3, wherein the push rod is adapted to be moved from the first position to the second position upon pressing of the activation member.

10. The hair brush of claim 9, wherein the brush head retainer is adapted to be removed from the handle upon movement of the push rod from the first position to the second position.

11. The hair brush of claim 10, wherein, with the brush head retainer removed from the handle, the brush head retainer is adapted to be coupled to the handle upon movement of the push rod from the first position to the second position.

12. The hair brush of claim 11, wherein, with the brush head retainer coupled to the handle, the brush head retainer is secured in place upon movement of the push rod from the second position to the first position.

13. The hair brush of claim 12, wherein, the push rod is adapted to be moved from the second position to the first position by releasing the activation member.

* * * * *